US008592011B2

(12) United States Patent
Noguchi et al.

(10) Patent No.: US 8,592,011 B2
(45) Date of Patent: Nov. 26, 2013

(54) INK JET RECORDING MEDIUM

(75) Inventors: Tetsuro Noguchi, Hachioji (JP); Hisao Kamo, Ushiku (JP); Yasuhiro Nito, Yokohama (JP); Isamu Oguri, Yokohama (JP); Ryo Taguri, Sagamihara (JP); Olivia Herlambang, Kawasaki (JP); Naoya Hatta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 229 days.

(21) Appl. No.: 13/088,608

(22) Filed: Apr. 18, 2011

(65) Prior Publication Data

US 2011/0256324 A1 Oct. 20, 2011

(30) Foreign Application Priority Data

Apr. 20, 2010 (JP) ..... 2010-097076

(51) Int. Cl.
*B41M 5/00* (2006.01)
*B41M 5/52* (2006.01)
*B41M 5/50* (2006.01)

(52) U.S. Cl.
CPC ..... *B41M 5/5218* (2013.01); *B41M 5/506* (2013.01); *B41M 5/52* (2013.01); *B41M 5/5245* (2013.01)
USPC ..... 428/32.21; 428/32.24; 428/32.25; 428/32.26; 428/32.28; 428/32.3; 428/32.34

(58) Field of Classification Search
CPC ..... B41M 5/5218; B41M 5/506; B41M 5/52; B41M 5/5245
USPC ..... 428/32.21, 32.24, 32.25, 32.26, 32.28, 428/32.3, 32.34
See application file for complete search history.

(56) References Cited

U.S. PATENT DOCUMENTS

| | | | | |
|---|---|---|---|---|
| 2002/0094420 | A1* | 7/2002 | Hatano et al. | 428/195 |
| 2003/0072925 | A1* | 4/2003 | Kiyama et al. | 428/195 |
| 2006/0078694 | A1* | 4/2006 | Motoda et al. | 428/32.24 |

FOREIGN PATENT DOCUMENTS

| | | | |
|---|---|---|---|
| CN | 1394170 | A | 1/2003 |
| CN | 1515427 | A | 7/2004 |
| CN | 101056823 | A | 10/2007 |
| JP | 2006-110771 | A | 4/2006 |

* cited by examiner

*Primary Examiner* — Betelhem Shewareged
(74) *Attorney, Agent, or Firm* — Canon USA Inc. IP Division

(57) ABSTRACT

In an ink jet recording medium having at least two ink receiving layers, the total content of boric acid, a borate, and a water-soluble zirconium salt of a lower ink receiving layer located close to a support substrate to the total content of alumina and an alumina hydrate thereof is higher than the total content of boric acid, a borate, and a water-soluble zirconium salt of an upper ink receiving layer located apart from the support substrate to the total content of alumina and an alumina hydrate thereof.

6 Claims, No Drawings

INK JET RECORDING MEDIUM

BACKGROUND OF THE INVENTION

1. Field of the Invention

The present invention relates to an ink jet recording medium.

2. Description of the Related Art

An ink jet recording medium generally includes a support substrate and an ink receiving layer provided thereon which has a porous structure in which a pigment, such as silica or an alumina hydrate, is held by a binder, such as a poly(vinyl alcohol) (PVA). The ink jet recording medium as described above is required to improve ink absorbency, color development property, bronzing resistance, and the like.

Japanese Patent Laid-Open No. 2006-110771 has disclosed an ink jet recording medium which has at least two ink receiving layers each containing fine silica particles on a support substrate. In this recording medium, at least one ink receiving layer apart from the support substrate contains a water-soluble zirconium compound, and a water-soluble aluminum compound is not uniformly distributed in the whole ink receiving layers and is more densely distributed in a portion thereof closer to the support substrate.

SUMMARY OF THE INVENTION

In high speed printing continuously performed on a recording medium, conveying accuracy is required to be improved when the recording medium is conveyed while being nipped between two rollers. In order to improve the conveying accuracy, hard rollers which are not likely to be deformed when nipping paper therebetween must be used. When the hard rollers as described above are used for conveyance, the quality of the recording medium may be degraded, for example, by a pressed mark (roller mark) formed by the rollers. In particular, since an ink receiving layer swells and softens due to moisture absorption in a high humidity environment, a roller mark is liable to be generated.

The present inventors carried out research on the roller mark by performing printing on the recording medium disclosed in Japanese Patent Laid-Open No. 2006-110771 using an ink jet printer. As a result, the roller mark was generated in a high humidity environment in some cases.

When a binder in the ink receiving layer is fully cross-linked by a cross linking agent, the generation of roller marks can be suppressed; however, when the cross linking agent is simply increased, the flexibility of the ink receiving layer against bending is liable to be degraded. Furthermore, since recent ink jet printers have been progressively miniaturized, a conveyance system in which a paper conveying path for a recording medium has a significantly high curvature tends to be adopted. Accordingly, when printing is performed by an ink jet printer, in a step of conveying paper, the recording medium is bent at a significantly high curvature, and in particular, when printing is performed in a low humidity environment, a crack (bending crack) is disadvantageously generated in the ink receiving layer.

Hence, the present invention provides an ink jet recording medium which suppresses the generation of roller marks and that of bending cracks while improving the ink absorbency, color development property, and bronzing resistance.

An ink jet recording medium according to the present invention comprises: a support substrate; and at least two ink receiving layers provided on this support substrate, wherein two ink receiving layers among the at least two ink receiving layers each contain at least one selected from alumina and an alumina hydrate, a poly(vinyl alcohol), at least one selected from boric acid and a borate, and a water-soluble zirconium compound, and the total content of boric acid, a borate, and a water-soluble zirconium salt of one of the two ink receiving layers located close to the support substrate to the total content of alumina and an alumina hydrate thereof is higher than the total content of boric acid, a borate, and a water-soluble zirconium salt of the other ink receiving layer located apart from the support substrate to the total content of alumina and an alumina hydrate thereof.

According to the present invention, the ink jet recording medium is provided which suppresses the generation of roller marks and that of bending cracks while improving the ink absorbency, color development property, and bronzing resistance.

Further features of the present invention will become apparent from the following description of exemplary embodiments.

DESCRIPTION OF THE EMBODIMENTS

Hereinafter, the details of the present invention will be described.

<Ink Jet Recording Medium>

An ink jet recording medium of the present invention has a support substrate and at least two ink receiving layers provided thereon. Of two ink receiving layer among the at least two ink receiving layers, one ink receiving layer (lower layer) is located close to the support substrate, and the other ink receiving layer (upper layer) is located apart from the support substrate. These two ink receiving layers are each a layer having a dry coating amount of at least 0.1 $g/m^2$ or more. On the upper layer, for example, for the purpose of gloss control or the like, an uppermost layer, which is not specified by the present invention, having a coating amount of less than 0.1 $g/m^2$ may also be provided. The uppermost layer is preferably a layer including, for example, particles, such as vapor phase method silica, colloidal silica, other inorganic fine particles, or organic fine particles, a hydrophilic binder, a cross linking agent, and an activator. Although the lower layer may be directly provided on the support substrate, for example, in order to improve the adhesion, ink fixability, and the like, another layer (pre-coat layer), which is not specified by the present invention, may be provided between the lower layer and the support substrate. The pre-coat layer is not particularly limited, and a layer having a known composition may be used.

Although described later, the two ink receiving layers of the present invention each contain at least one selected from alumina and an alumina hydrate, a poly(vinyl alcohol), at least one selected from boric acid and a borate, and a water-soluble zirconium compound. On the other hand, ink receiving layers other than these two ink receiving layers each do not contain all of at least one selected from alumina and an alumina hydrate, a poly(vinyl alcohol), at least one selected from boric acid and a borate, and a water-soluble zirconium compound. In addition, the ink jet recording medium of the present invention may have ink receiving layers on two surfaces of the support substrate.

<Support Substrate>

As the support substrate used for the present invention, for example, there may be mentioned water absorbing support substrates, such as regular paper and coated paper, and water resistant support substrates, such as synthetic paper, a plastic film, and resin-coated paper. In particular, resin-coated paper formed by covering base paper with a resin-coating layer is preferably used. Although the base paper of the resin-coated paper is not particularly limited, and common paper may be used, for example, smooth base paper used as a photographic support substrate is preferable. As pulp forming the base paper, natural pulp, regenerated pulp, synthetic pulp, and the like may be used alone, or at least two thereof may be mixed together for use. Additives generally used for paper making, such as a sizing agent, a paper reinforcing agent, a filler, an antistatic agent, a fluorescent brightener, and a dye may be blended with this base paper. Furthermore, for example, a surface sizing agent, a paper-surface strength agent, a fluorescent brightener, an antistatic agent, a dye, an anchoring agent may be applied to the surface of the base paper.

The thickness of the base paper for the resin-coated paper is preferably 50 μm or more. If having a thickness of 50 μm or more, the base paper maintains a sufficient strength against pulling and tearing and can also suppress degradation in its texture. Although the upper limit of the thickness of the base paper is not particularly limited, the thickness thereof is preferably 350 μm or less. If the thickness is 350 μm or less, the recording medium is preferably prevented from being inconveniently handled, and the cost thereof is also preferably prevented from being increased. Furthermore, as the base paper, paper having good surface smoothness is preferable which is processed by a surface treatment performed, for example, in such a way that pressure is applied by calendering or the like during or after paper formation, and base paper having a density of 0.6 to 1.2 g/cm$^3$ is preferably used. When the density is 1.2 g/cm$^3$ or less, sufficient cushioning properties can be maintained. In addition, base paper having the above density is excellent in conveyance properties. In addition, when the density is 0.6 g/cm$^3$ or more, the surface smoothness can be improved. The density is more preferably 0.7 g/cm$^3$ or more.

The thickness of a resin-coating layer of the resin-coated paper is preferably 5 to 50 μm and more preferably 8 to 40 μm. Fundamentally, the thickness of the resin-coating layer is appropriately determined from a curling property which relates to the thickness of the base paper; however, when the thickness is 5 μm or more, an increase in water and/or gas permeability from the resin surface and generation of cracks in the ink receiving layer by bending can be preferably prevented. In addition, when the thickness is 50 μm or less, curling resistance can be preferably prevented from being degraded.

As a resin used for the resin-coating layer, a low-density polyethylene (LDPE) or a high-density polyethylene (HDPE) is preferably use. As another resin, a linear low-density polyethylene (LLDPE), a polypropylene, or the like may also be used.

A resin-coating layer at the side (surface side) at which the ink receiving layer is formed is preferably a resin-coating layer having improve opacity, whiteness degree, and hue which is formed by adding rutile or anatase type titanium oxide, a fluorescent brightener, and the like to a polyethylene. The content of titanium dioxide in the resin-coating layer at the side (surface side) at which the ink receiving layer is formed is, with respect to the resin in the resin-coating layer, preferably 3 to 20 percent by mass and more preferably 4 to 13 percent by mass.

As the resin-coated paper, for example, glossy paper may be used, and in addition, paper may also be used having a silky surface such as that obtained in common photographic paper by performing a so-called embossing treatment when a polyethylene is applied on the surface of the base paper by melt extrusion.

In addition, as the plastic film used for the present invention, for example, a thermoplastic, such as a polyethylene, a polypropylene, a polystyrene, a poly(vinyl chloride) or a polyester, may be mentioned. In addition, a film manufactured, for example, from a thermosetting resin, such as a urea resin, a melamine resin, or a phenol resin, may be mentioned. The thickness of the plastic film used for the present invention is preferably 50 to 250 μm.

<Ink Receiving Layer>

The two ink receiving layers of the ink jet recording medium according to the present invention each contain at least one selected from alumina and an alumina hydrate, a poly(vinyl alcohol), at least one selected from boric acid and a borate, and a water-soluble zirconium compound.

The present inventors found that when a water-soluble zirconium compound was used as a second cross-linking agent together with at least one selected from boric acid and a borate used as a cross-linking agent, the degree of easiness of forming a roller mark on the ink receiving layer could be significantly improved.

On the other hand, it was also found that by using at least one selected from boric acid and a borate together with a water-soluble zirconium compound, when printing is performed in a low humidity environment by a recent ink jet printer in which the conveying path has a high curvature, cracks (bending cracks) are liable to be generated.

Accordingly, the present inventors further carried out intensive research in order to solve the problem generated by using at least one selected from boric acid and a borate together with a water-soluble zirconium compound and to suppress the generation of roller marks caused by the above combination use. As a result, the present inventors found the solution of the problem described above, that is, when the structure is formed in such a way that the ink receiving layer is formed to have a multilayer structure having at least two layers, and the total content of boric acid, a borate, and a water-soluble zirconium salt in an ink receiving layer located close to the support substrate to the total content of alumina and an alumina hydride thereof is higher than the total content of boric acid, a borate, and a water-soluble zirconium salt in an ink receiving layer located apart from the support substrate to the total content of alumina and an alumina hydride thereof, the problem described above can be overcome. In the present invention, the difference between the total content of boric acid, a borate, and a water-soluble zirconium salt of the lower layer to the total content of alumina and an alumina hydrate thereof and the total content of boric acid, a borate, and a water-soluble zirconium salt of the upper layer to the total content of alumina and an alumina hydrate thereof is preferably 0.2 to 3.0 percent by mass, more preferably 0.5 to 1.7 percent by mass, and even more preferably 0.7 to 1.5 percent by mass.

Incidentally, the ink receiving layer is a solid material of an ink receiving-layer coating liquid and can be formed by applying the above ink receiving-layer coating liquid to the support substrate, followed by performing drying. Accordingly, for example, the total amount of boric acid, a borate, and a water-soluble zirconium salt contained in the lower layer to the total amount of alumina and an alumina hydrate contained therein is approximately equivalent to the total content of boric acid, a borate, and a water-soluble zirconium salt contained in the ink receiving-layer coating liquid forming the lower layer to the total content of alumina and an alumina hydride contained therein. As described above, as the uppermost layer, the pre-coat layer, and the like other than the two ink receiving layers specified by the present invention, layers each having a known composition may be used. Hereinafter, the coating liquid will be described in detail.

The ink receiving-layer coating liquid used for the present invention contains a dispersion liquid in which at least one selected from alumina and an alumina hydrate is deflocculated by a deflocculating acid which will be described later, a poly(vinyl alcohol), at least one selected from boric acid and a borate, and a water-soluble zirconium compound.

[Ink Receiving-Layer Coating Solution]

(Alumina and Alumina Hydrate)

The ink receiving layer of the present invention contains at least one selected from alumina and an alumina hydrate as a pigment.

The alumina hydrate preferably used in the present invention is represented by the following general formula (1).

$$Al_2O_{3-n}(OH)_{2n}.mH_2O \qquad \text{General formula (1)}$$

(In the above formula, n indicates one of 0, 1, 2, and 3, and m indicates 0 to 10 and preferably 0 to 5. Since $mH_2O$ indicates a detachable water phase not responsible for forming a crystal lattice in many cases, m may not be an integer in some cases. In addition, when the alumina hydrate is calcined, m may be 0. However, n and m may not be 0 at the same time.)

Among those described above, an alumina hydrate having a boehmite structure or an amorphous structure analyzed by an X-ray diffraction method is preferable. As particular examples, alumina hydrates disclosed, for example, in Japanese Patent Laid-Open Nos. 7-232473, 8-132731, 9-66664, and 9-76628 may be mentioned. As a particular example of the shape of the alumina hydrate used for the present invention, an amorphous alumina hydrate or a spherical or a tabular alumina hydrate may be mentioned, and these alumina hydrates may be used alone or in combination. In particular, an alumina hydrate in which the number average particle diameter of the primary particles is 5 to 50 nm is preferable, and a tabular alumina hydrate having an aspect ratio of 2 or more is preferable.

The aspect ratio can be obtained by a method disclosed in Japanese Patent Publication No. 5-16015. That is, the aspect ratio is represented by the ratio of the "diameter" of a particle to the "thickness" thereof. The diameter in this case indicates the diameter (circle corresponding diameter) of a circle having an area equal to the project area of a particle obtained when an alumina hydrate is observed with a microscope or an electron microscope. In addition, an alumina hydrate having a specific surface area of 100 to 200 $m^2/g$ calculated based on a BET method is preferable, and an alumina hydrate having a specific surface area of 125 to 175 $m^2/g$ is more preferable. A BET method is one surface area measuring method of a powder by a vapor phase adsorption method and is a method for obtaining the total surface area of 1 g of a sample, that is, the specific surface area, from an adsorption isotherm. This BET method generally uses a nitrogen gas as an adsorption gas, and a method for measuring an adsorption amount from the change in pressure or volume of the adsorption gas is most frequently used. In this measurement, the equation of Brunauer, Emmett, and Teller, called a BET equation, is the most prominent equation representing the isotherm of multimolecular adsorption and has been widely used to determine the specific surface area. In the above BET method, the adsorption amount is obtained based on the BET equation and is multiplied by the area of the surface occupied by one adsorbed molecule, thereby obtaining the specific surface area. In the BET method, several relationships between the relative pressure and the adsorption amount are measured by measurement performed in accordance with a nitrogen adsorption desorption method, and the slope and intercept of plots of the above relationships are obtained by the least square method, thereby obtaining the specific surface area. In the present invention, 10 relationships between the relative pressure and the adsorption amount are measured for calculation.

The alumina hydrate may be manufactured by known methods, such as a method for hydrolyzing an aluminum alkoxide and a method for hydrolyzing sodium aluminate, as disclosed in U.S. Pat. Nos. 4,242,271 and 4,202,870. In addition, the alumina hydrate may also be manufacture by a known method, such as a method for adding an aqueous solution of aluminum sulfate, aluminum chloride, or the like to an aqueous solution of sodium aluminate or the like for neutralization, disclosed, for example, in Japanese Patent Publication No. 57-447605. As particular examples of preferable alumina hydrates used for the present invention, the following may be mentioned by way of example. That is, an alumina hydrate having a boehmite structure or an amorphous structure analyzed by an X-ray diffraction method may be mentioned, and in particular, alumina hydrates disclosed, for example, in Japanese Patent Laid-Open Nos. 7-232473, 8-132731, 9-66664, and 9-76628, may be mentioned. Furthermore, as a particular example of the alumina hydrate, a commercially available alumina hydrate (trade name: DISPERAL HP14, manufactured by Sasol Ltd.) may also be mentioned.

As the alumina, for example, γ-alumina, α-alumina, δ-alumina, θ-alumina, and x-alumina may be mentioned. Among these mentioned above, γ-alumina synthesized by a vapor phase method is preferable in terms of color development property and ink absorbency. In addition, γ-alumina is obtained by heating and firing an alumina hydrate manufactured by a known method at a temperature of 400° C. to 900° C.

The alumina hydrates and alumina described above may be mixed and used. That is, a powdered alumina hydrate and powdered alumina are mixed and dispersed to form a dispersion liquid, or an alumina hydrate dispersion liquid and an alumina dispersion liquid may be mixed and used.

In particular, since the ink absorbency is particularly improved, an alumina hydrate mixed with γ-alumina synthesized by a vapor phase method is preferably used for the upper layer of the present invention. The mixing mass ratio of the alumina hydrate to the γ-alumina synthesized by a vapor phase method is preferably 50:50 to 95:5. In addition, the mixing mass ratio is more preferably 70:30 to 90:10. In the present invention, as long as the advantages of the present invention are not degraded, other pigments, such as vapor phase method silica and magnesium hydroxide, may also be used as a pigment together with at least one selected from alumina and an alumina hydrate.

(Dispersion Liquid)

It is preferable that at least one selected from alumina and an alumina hydrate used for the present invention be in the state of an aqueous dispersion liquid deflocculated by a deflocculating agent and be contained in an ink receiving-layer coating liquid. When an alumina hydrate and alumina are each used independently, an alumina-hydrate dispersion liquid and an alumina dispersion liquid are each prepared as an aqueous dispersion liquid deflocculated by a deflocculating agent. A dispersion liquid containing at least one selected from an alumina hydrate and alumina used for the present invention contains at least one of an alumina hydrate and alumina and a deflocculating agent.

In the present invention, an acid (deflocculating acid) is preferably used as a deflocculating agent. In particular, as this deflocculating acid, a monovalent sulfonic acid represented by the following general formula (2) is preferably used since ozone resistance of an image is significantly excellent, and image blurring in a high humidity environment can be preferably suppressed.

$$R—SO_3H \qquad \text{General formula (2)}$$

(In the general formula (2), R indicates a hydrogen atom or a branched or non-branched alkyl or alkenyl group having 1 to 3 carbon atoms. However, R may have at least one selected from an oxo group, a halogen atom, an alkoxy group (—OR'), and acyl groups (R'—CO—) as a substituent, and R' indicates a hydrogen atom, a methyl group, or an ethyl group.)

As particular examples of the sulfonic acid represented by the general formula (2), the following may be mentioned. That is, for example, methanesulfonic acid, ethanesulfonic acid, 1-propanesulfonic acid, 2-propanesulfonic acid, chloromethanesulfonic acid, dichloromethanesulfonic acid, trichloromethanesulfonic acid, and trifluoromethanesulfonic acid may be mentioned. These compounds mentioned above may be used alone or in combination.

The dispersion liquid containing both an alumina hydrate and alumina may be prepared in such a way that, for example, a powdered alumina hydrate and powdered alumina are mixed together, and an acid and a dispersion medium are added thereto together with the aforementioned additives if necessary. Furthermore, the dispersion liquid containing both an alumina hydrate and alumina may also be prepared in such a way that, after an alumina-hydrate dispersion liquid and an alumina dispersion liquid are separately prepared, theses two dispersion liquids are mixed together.

A sol-solid content concentration of the coating liquid is preferably set to 10 to 40 percent by mass. When the sol-solid content concentration is 10 percent by mass or more, the generation of cracks can be preferably prevented during coating. When the sol-solid content concentration is 40 percent by mass or less, easy gellation caused by an unstable sol can be preferably prevented, and hence, coating properties can be preferably prevented from being degraded. In view of viscosity stability of the sol, the sol-solid content concentration is particularly preferable 20 to 35 percent by mass. Incidentally, the sol-solid content concentration of the coating liquid indicates the ratio in percentage of the mass of the total solid content of the sol in the coating liquid occupied in the sol thereof.

The amount of the acid for deflocculating an alumina hydrate and alumina used for the present invention is determined, for example, by the type of acid, and the particle sizes and specific surface areas of an alumina hydrate and alumina. In particular, in the coating liquid containing at least one selected from an alumina hydrate and alumina, a deflocculating acid in an amount of 100 to 500 mmol is preferably contained to a total amount of 1 kg of an alumina hydrate and alumina. When the amount of the deflocculating acid is 100 mmol or more, a serious increase in viscosity of the sol can be preferably prevented. On the contrary, in the case in which the amount of the deflocculating acid is 500 mmol or less, the generation of bronzing and beading can be preferably prevented, and hence image quality can be preferably prevented from being degraded.

The particles in the dispersion liquid containing at least one selected from an alumina hydrate and alumina may also be allowed to have a desired particle diameter by further performing a physical treatment using a pulverizing and deflocculating machine or the like. As the pulverizing and deflocculating machine, various known deflocculating machines may be used. For example, a high-pressure homogenizer, an ultrasonic homogenizer, a wet media type grinder (a sand mill or a ball mill), a continuous high-speed agitation type deflocculating machine, and an ultrasonic deflocculating machine may be mentioned.

The dispersion liquid containing at least one selected from an alumina hydrate and alumina may further contain, for example, a pigment dispersant, a thickener, a fluid improving agent, a defoaming agent, a foam suppressor, a surfactant, a releasing agent, a penetrant, a coloring pigment, a coloring dye, a fluorescent brightener, an ultraviolet absorber, an antioxidant, an antiseptic, a fungicide, a water resistant additive, a dye fixing agent, a curing agent, and a weather resistant material. As a dispersion medium for the dispersion liquid containing at least one selected from an alumina hydrate and alumina, water is preferably used.

(Polyvinyl Alcohol)

The ink receiving layer of the present invention contains a poly(vinyl alcohol) as a binder. In particular, in view of ink absorbency, as the poly(vinyl alcohol), a completely or partially saponificated poly(vinyl alcohol) or a cation modified poly(vinyl alcohol) is preferably used. Furthermore, in view of water resistance and color development property, a poly (vinyl alcohol) having a weight average degree of polymerization of 2,000 or more and a saponification degree of 85 to 98 percent by mole is more preferably used. In addition, the weight average degree of polymerization is more preferably 2,000 to 5,000.

As the cation modified poly(vinyl alcohol), for example, as disclosed in Japanese Patent Laid-Open No. 61-10483, a poly(vinyl alcohol) having one of a primary to a tertiary amino group or a quaternary ammonium group in its main chain or side chain is preferable.

The poly(vinyl alcohol) is preferably used in an aqueous solution state. A poly(vinyl alcohol) dry solid content concentration of an aqueous solution containing a poly(vinyl alcohol) is preferably 3 to 20 percent by mass. When the dry solid content concentration is set as described above, a serious decrease in drying speed due to an excessive decrease in concentration of the coating liquid can be preferably prevented, and on the other hand, a serious increase in viscosity of the coating liquid due to an increase in concentration thereof can be suppressed, so that, in particular, the smoothness of a coating surface can be prevented from being degraded. In addition, although a binder other than a poly (vinyl alcohol) may also be used together therewith if needed, in view of color development property, the amount of the binder is preferably set to 50 percent by mass or less to the amount of a poly(vinyl alcohol) to be used.

The amount of a poly(vinyl alcohol) contained in a coating liquid (hereinafter referred to as an "upper-layer forming coating liquid") forming the upper layer of the ink receiving layer is, with respect to the total solid content amount of alumina and an alumina hydrate contained in the upper-layer forming coating liquid, preferably 5.0 to 15.0 percent by mass in consideration of coating-surface cracks generated during drying and/or ink absorbency, more preferably 5.0 to 13.0 percent by mass, and even more preferably 7.0 to 11.0 percent by mass. In addition, the amount of a poly(vinyl alcohol) contained in a coating liquid (hereinafter referred to as a "lower-layer forming coating liquid") forming the lower layer of the ink receiving layer is, with respect to the total solid content amount of alumina and an alumina hydrate contained in the lower-layer forming coating liquid, preferably 5.0 to 15.0 percent by mass in consideration of coating-surface cracks generated during drying and/or ink absorbency, more preferably 7.0 to 15.0 percent by mass, and even more preferably 8.0 to 13.0 percent by mass.

(Boric Acid and Borate)

The ink receiving layer of the present invention contains at least one selected from boric acid and a borate. Although at least one of boric acid and a borate may be added to the ink receiving-layer coating liquid together with a poly(vinyl alcohol), the addition order of the above compounds is not particularly limited. In this case, as boric acid used as a cross linking agent, for example, orthoboric acid ($H_3BO_3$), metaboric acid, and hypoboric acid may be mentioned. As a borate, a for example, an orthoborate, such as $InBO_3$, $ScBO_3$, $YBO_3$, $LaBO_3$, $Mg_3(BO_3)_2$, or $Co_3$ $(BO_3)_2$; a diborate, such as $Mg_2B_2O_5$ or $Co_2B_2O_5$; a metaborate, such as, $LiBO_2$, $Ca(BO_2)_2$, $NaBO_2$, or $KBO_2$); a tetraborate such as $Na_2B_4O_7 \cdot 10H_2O$, a pentaborate, such as $KB_5O_8 \cdot 4H_2O$, $Ca_2B_6O_{11} \cdot 7H_2O$, or $CsB_5O_5$, may be mentioned. Among these boric acids and borates, orthoboric acid is preferably used in view of stability of the coating liquid with time and an effect of suppressing the generation of cracks. The orthoboric acid is preferably used in an aqueous solution state. The dry solid content concentration of an aqueous solution containing orthoboric acid is preferably 0.5 to 8.0 percent by mass. When the solid content concentration is set as described above, a serious decrease in drying speed due to a decrease in concentration of the coating liquid can be preferably prevented, and in particular, the orthoboric acid can be prevented from being precipitated. As a method for adding boric acid and a borate, for example, the following methods may be mentioned. There may be mentioned, for example, a method in which, after boric acid and a borate are directly added to a coating liquid, coating is performed by a batch system; a method in which boric acid and a borate are added beforehand to a dispersion liquid of an alumina hydrate or alumina, and while the dispersion liquid and a binder are continuously mixed together immediately before coating, coating is performed; a method in which boric acid and a borate are separately dissolved in aqueous media and are in-line added to a coating liquid immediately before coating; and a method in which before and after a coating liquid containing a binder and an alumina hydrate or alumina is applied, a solution containing boric acid and a borate is applied, and any methods described above may be used. The addition amount of boric acid and a borate contained in the upper-layer forming coating liquid is, with respect to the total amount of alumina and an alumina hydrate contained therein, is preferably 0.3 to 2.0 percent by mass in view of stability of the coating liquid with time and an effect of suppressing the generation of cracks and is more preferably 0.5 to 1.5 percent by mass. In addition, the addition amount of boric acid and a borate contained in the lower-layer forming coating liquid is, with respect to the total amount of alumina and an alumina hydrate contained therein, is preferably 1.0 to 2.5 percent by mass in view of stability of the coating liquid with time and an effect of suppressing the generation of cracks and is more preferably 1.7 to 2.2 percent by mass. Furthermore, the addition amount of boric acid and a borate to the total amount of alumina and an alumina hydrate in the lower-layer forming coating liquid is preferably larger than the addition amount of boric acid and a borate to the total amount of alumina and an alumina hydrate in the upper-layer forming coating liquid.

In addition, the amount of boric acid and a borate contained in each of the upper-layer forming coating liquid and the lower-layer forming coating liquid is, with respect to the amount of a poly(vinyl alcohol) contained in each coating liquid, preferably 2 to 40 percent by mass in view of stability of the coating liquid with time and an effect of suppressing the generation of cracks. The amount of boric acid and a borate described above is more preferably 5 to 25 percent by mass.

(Water-Soluble Zirconium Compound)

The ink receiving layer of the present invention contains a water-soluble zirconium compound. As an example of the water-soluble zirconium compound, for example, zirconium acetate, zirconium nitrate, basic zirconium carbonate, zirconium hydroxide, ammonium zirconium carbonate, potassium zirconium carbonate, zirconium sulfate, zirconium fluoride, zirconium chloride, zirconium chloride octahydrate, zirconium oxychloride, or hydroxy zirconium chloride may be mentioned. Among these water-soluble zirconium compounds, zirconium acetate (zirconyl acetate) and zirconium oxychloride are particularly preferable since cross-linking by boric acid is not so much disturbed due to an extreme decrease in pH of the ink receiving-layer coating liquid. One water-soluble zirconium compound may be used alone, or at least two types thereof may be used in combination.

As a method for adding a water-soluble zirconium compound, the following methods may be mentioned. For example, there may be mentioned a method in which, after a water-soluble zirconium compound is directly added to a coating liquid, coating is performed by a batch system; a method in which a water-soluble zirconium compound is added beforehand to a dispersion liquid of an alumina hydrate or alumina, and while the dispersion liquid and a binder are continuously mixed together immediately before coating, the coating is performed. In addition, for example, there may also be mentioned a method in which a water-soluble zirconium compound is dissolved in a separated aqueous medium and is in-line added to a coating liquid immediately before coating; and a method in which before and after a coating liquid containing a binder and an alumina hydrate or alumina is applied, a solution containing a water-soluble zirconium compound is applied, and any methods described above may be used.

The addition amount of a water-soluble zirconium compound contained in each of the upper-layer forming coating liquid and the lower-layer forming coating liquid is, with respect to the amount of a poly(vinyl alcohol) contained in each coating liquid, preferably 2 to 40 percent by mass in view of stability of the coating liquid with time and an effect of suppressing the generation of cracks and is more preferably 5 to 25 percent by mass.

The addition amount of a water-soluble zirconium compound contained in the upper-layer forming coating liquid is, with respect to the total amount of alumina and an alumina hydrate contained therein, is preferably 0.05 to 1.00 percent by mass in view of stability of the coating liquid with time and an effect of suppressing the generation of cracks and is more preferably 0.1 to 0.5 percent by mass. The addition amount of a water-soluble zirconium compound contained in the lower-layer forming coating liquid is, with respect to the total amount of alumina and an alumina hydrate contained therein, is preferably 0.3 to 2.20 percent by mass in view of stability of the coating liquid with time and an effect of suppressing the generation of cracks and is more preferably 0.45 to 0.7 percent by mass. In addition, the addition amount of a water-soluble zirconium compound contained in the lower-layer forming coating liquid to the total amount of alumina and an alumina hydrate contained therein is preferably larger than the addition amount of a water-soluble zirconium compound contained in the upper-layer forming coating liquid to the total amount of alumina and an alumina hydrate contained therein.

In addition, the addition amount of a water-soluble zirconium compound contained in the upper-layer forming coating liquid to the total amount of alumina and an alumina hydrate contained therein is preferably smaller than the addition amount of boric acid and a borate contained in the upper-layer forming coating liquid to the total amount of alumina and an alumina hydrate contained therein. In addition, the ratio of the addition amount of a water-soluble zirconium compound contained in the upper-layer forming coating liquid to the addition amount of boric acid and a borate contained therein is preferably 1:1 to 1:10 and more preferably 1:2 to 1:8.

The addition amount of a water-soluble zirconium compound contained in the lower-layer forming coating liquid to the total amount of alumina and an alumina hydrate contained therein is preferably smaller than the addition amount of boric acid and a borate contained in the lower-layer forming coating liquid to the total amount of alumina and an alumina hydrate contained therein. In addition, the ratio of the addition amount of a water-soluble zirconium compound contained in the lower-layer forming coating liquid to the addition amount of boric acid and a borate contained therein is preferably 1:1 to 1:8 and more preferably 1:3 to 1:6.

(Additives)

In the upper-layer and the lower-layer ink receiving layers and the coating liquids thereof, if needed, various types of additives may be contained. For example, there may be mentioned fixing agents, such as various cationic resins, a resin emulsion, a flocculating agent, such as a polyvalent metal salt, a surfactant, a fluorescent brightener, a thickener, a defoaming agent, a foam suppressor, a releasing agent, a penetrant, a lubricant, an ultraviolet absorber, an antioxidant, a leveling agent, an antiseptic, and a pH regulator. The addition amount thereof may be appropriately adjusted.

As an example of the cationic resin which can be used for the present invention, for example, a polyethyleneimine resin, a polyamine resin, a polyamide resin, a polyamide-epichlorohydrin resin, a polyamine-epichlorohydrin resin, a polyamide-polyamine-epichlorohydrin resin, a polydiallylamine resin, and a dicyandiamide condensate may be mentioned. These cationic resins may be used alone or in combination.

Among the cationic resins mentioned above, a diallylamine resin, in particular, a diallylamine hydrochloride-sulfur dioxide copolymer resin is preferable since having an excellent effect of suppressing image blurring in a high humidity environment. Incidentally, since a diallylamine hydrochloride-sulfur dioxide copolymer resin has a high dye aggregation function in ink and is liable to generate bronzing when being present on the surface of the ink receiving layer, it is preferable to add the above copolymer resin only to the lower-layer ink receiving layer of the present invention. The addition amount of a diallylamine hydrochloride-sulfur dioxide copolymer resin to the lower-layer ink receiving layer is, with respect to the total amount of alumina and an alumina hydrate contained therein, preferably 0.1 to 2.0 percent by mass and more preferably 0.3 to 1.0 percent by mass.

As the resin emulsion which can be used for the present invention, a cationic polyurethane-based emulsion is preferable in view of miscibility with a coating liquid, an effect of improving ink absorbency, and an effect of suppressing image blurring in a high humidity environment. In particular, a cationic polyurethane may be mentioned which contains sulfur as a constituent element obtained by a reaction between at least two types of compounds, that is, a sulfur-containing compound having at least two active hydrogen groups and a polyisocyanate compound having at least two isocyanate groups. A high molecular weight compound which contains sulfur as a constituent element is preferably a cationic polyurethane obtained by a reaction between a sulfur-containing compound having at least two active hydrogen groups, a polyisocyanate compound, a polyether compound having at least two active hydrogen groups as a hydrophilic functional group, and an amine compound having at least two active hydrogen groups.

In addition, the high molecular weight compound obtained by a reaction between at least two types of compounds, that is, a sulfur-containing compound having at least two active hydrogen groups and a polyisocyanate compound having at least two isocyanate groups, functions as a binder. As a result, an effect of suppressing the generation of roller marks and image blurring is obtained. In view of ink absorbency and suppression of color irregularity, the total amount of a poly (vinyl alcohol) and the above high molecular weight compound is preferably set to 16.9 percent by mass or less with respect to the coating liquid.

It is confirmed that a coloring material component in ink absorbed in the ink receiving layer is fixed near a surface layer thereof at a high density. A dyeing position of the coloring material component is fixed in a region from the surface layer to a depth of 20 μm. In the above region, the coloring material component is fixed at a high concentration from the surface layer to a depth of 10 μm. For this reason, although the above sulfur-containing compound may be uniformly added in the ink receiving layer, the above compound is preferably add therein from the surface layer to a depth of 20 μm and more preferably from the surface layer to a depth of 10 μm.

In the upper layer of the ink receiving layer of the present invention, the total content of boric acid, a borate, and a water-soluble zirconium salt to the total content of alumina and an alumina hydrate is lower than that in the lower layer. As a result, since the total cross linking agent concentration of the upper layer is low, the roller-mark resistance of the upper layer in a high humidity environment is liable to be inferior to that of the lower layer. On the other hand, the bending crack resistance in a low humidity environment tends to be superior. For this reason, it is required to maintain the coating amount balance between the upper layer and the lower layer, and the solid content coating amount of the upper layer is preferably 5 to 20 g/m$^2$. Furthermore, the above amount is more preferably 7 to 15 g/m$^2$.

In the lower layer of the ink receiving layer of the present invention, the total content of boric acid, a borate, and a water-soluble zirconium salt to the total content of alumina and an alumina hydrate is higher than that in the upper layer. As a result, since the total cross linking agent concentration of the lower layer is high, the roller-mark resistance of the lower layer in a high humidity environment tends to be superior to that of the upper layer. On the other hand, the bending crack resistance in a low humidity environment is liable to be inferior. For this reason, it is required to maintain the coating amount balance between the upper layer and the lower layer, and the solid content coating amount of the lower layer is preferably 15 to 40 g/m$^2$. Furthermore, the above amount is more preferably 20 to 35 g/m$^2$.

As a method for forming the ink receiving layer of the present invention, the coating liquid may be applied by a known coating method. For example, there may be mentioned a slot-die method, a slide bead method, a curtain method, an extrusion method, an air knife method, a roll coating method, or a rod bar coating method. Coating liquids for at least two ink receiving layers used for the present invention may be applied by a simultaneous multilayer coating as well as by a sequential coating, followed by drying. In particular, a simultaneous multilayer coating by a slide bead method is a preferable method since having a high productivity. For drying performed after the coating, for example, hot air drying devices, such as a linear drying tunnel, an arch dryer, an air loop dryer, a sine curve air float dryer, and a heating dryer, and dryers using infrared rays, microwaves, and the like may be appropriately selected.

EXAMPLES

Hereinafter, although the present invention will be described in detail with reference to examples and comparative examples, the contents of the present invention are not limited to the following examples. Incidentally, "part(s)" or "%" is on the mass basis unless otherwise particularly described.

(Formation of Support Substrate)

To 100 parts by mass of a pulp slurry containing leaf bleached kraft pulp (LBKP) having a freeness of 450 ml CSF (Canadian Standard Freeness), needle bleached kraft pulp (NBKP) having a freeness of 480 ml CSF, and water (mixing ratio of LBKP to NBKP was 8:2 on the mass basis), 0.60 parts by mass of cationized starch, 10 parts by mass of heavy calcium carbonate, 15 parts by mass of light calcium carbonate, 0.10 parts by mass of an alkyl ketene dimer, and 0.03 parts by mass of a cationic polyacrylamide were externally added. As described above, a paper material was prepared. After the preparation, paper formation was performed by a Fourdrinier paper machine, a three-step wet press was performed, and drying was further performed by a multiple cylinder dryer. Subsequently, by using a size press device, the paper material thus processed was impregnated in an oxidized starch aqueous solution so as to have a solid content (oxidized starch) of 1.0 g/m$^2$, and after drying, machine calendering finish was carried out, so that base paper having a basis weight of 155 g/m$^2$ was obtained.

On the surface side of the above base paper, a resin composition formed of a low density polyethylene (70 parts), a high density polyethylene (20 parts), and titanium oxide (10 parts) was applied to have a weight per square of 25 g/m$^2$, thereby forming a resin-coating layer. On the rear surface side of the base paper, a resin composition formed of a high density polyethylene (50 parts) and a low density polyethylene (50 parts) was applied at a weight per square of 30 g/m$^2$ to form a resin-coating layer, thereby forming a resin-coated paper.

After corona discharge was carried out on the surface side of this resin-coated paper, an easy adhesive layer was formed by applying acid-treated gelatin so as to have a solid content coating amount of 0.05 g/m$^2$, and corona discharge was carried out on the rear surface side of the resin-coated paper. Subsequently, a back layer containing approximately 0.4 g of a styrene-acrylic ester latex binder having a Tg (glass transition point) of approximately 80° C., 0.1 g of an antistatic agent (cationic polymer), and 0.1 g of colloidal silica as a mat agent was applied to the rear surface side, thereby forming the support substrate.

[Formation of Recording Medium 1]

(Preparation of Alumina-Hydrate Dispersion Liquid)

To 333 parts of ion exchange water, 1.65 parts of methanesulfonic acid was added as a deflocculating acid. While this methanesulfonic-acid aqueous solution was agitated at a rotation condition of 3,000 rpm by a homomixer (trade name: T.K. Homomixer MARK 112.5 type, manufactured by Tokushu Kika Co., Ltd.), 100 parts of alumina hydrate (DISPERAL HP14, manufactured by Sasol Inc.) was added little by little. After the addition was finished, agitation was continuously performed for 30 minutes, so that an alumina-hydrate dispersion liquid having a solid content concentration of 23% was prepared.

(Preparation of Alumina Dispersion Liquid)

As a deflocculating acid, 1.65 parts of methanesulfonic acid was added to 333 parts of ion exchange water. This methanesulfonic-acid aqueous solution was agitated under a rotation condition of 3,000 rpm by a homomixer (trade name: T.K. homomixer MARK 112.5 type, manufactured by Tokushu Kika Co., Ltd.). While agitation was performed, 100 parts of vapor phase method γ-alumina (Aeroxide Alu C, manufactured by Evonik Degussa GmbH) was added little by little. After the addition was finished, agitation was continuously performed for 30 minutes, so that an alumina dispersion liquid having a solid content concentration of 23% was prepared.

(Preparation of Cationic Polyurethane-Based Emulsion)

A cationic polyurethane emulsion was prepared as described below.

To a reaction vessel equipped with an agitating device, a thermometer, and a reflux condenser tube, 109 g of acetone was charged as a reaction solvent. While agitation was performed, 40.00 g of 3,6-dithia-1,8-octanediol and 6.79 g of methyl diethanolamine were dissolved, and after the temperature was increased to 40° C., 62.07 g of isophorone diisocyanate was added. After the temperature was then increased to 50° C., and 0.2 g of a tin-based catalyst was added, the temperature was further increased to 55° C., and while agitation was performed, a reaction was performed for 4 hours. After the reaction was finished, the reaction solution was cooled to room temperature, and 3.09 g of formic acid at a concentration of 85% was added, so that a reaction product was cationized. After 446 g of water was further added, acetone was removed by vacuum concentration, and concentration adjustment was performed with water, so that a cationic emulsion 1 having a solid content of 20% was formed. The average particle diameter of the obtained cationic emulsion 1 measured by a laser particle size analysis apparatus PARIII (manufactured by Otsuka Electronics Co., Ltd.) was 50 nm.

(Preparation of Vapor Phase Method-Silica Dispersion Liquid)

To 420 parts of ion exchange water, 5 parts of dimethyl diallyl ammonium chloride homopolymer (trade name: Sharoll DC902P, manufactured by Dai-Ichi Kogyo Seiyaku Co., Ltd.) was added in a suction type dispersion agitator Conti-TDS. Furthermore, 100 parts of vapor phase method silica (trade name: AEROSIL300, manufactured by Nippon Aerosil Co., Ltd.) was added little by little at a maximum rotation speed and was dispersed for 24 hours, thereby obtaining a vapor phase method-silica dispersion liquid having a solid content concentration of 20%.

Next, coating liquids for the ink receiving layer having the following compositions (for the upper layer and the lower layers) were prepared using the liquids prepared as described above. The coating liquid composition was prepared so that the total solid content of the pigment was 100 parts.

(Composition of Upper-Layer Coating Liquid A1)

- Alumina-hydrate dispersion liquid 348.00 parts
- Alumina dispersion liquid 87.00 parts
- Cationic polyurethane emulsion 15.00 parts
- Poly(vinyl alcohol) aqueous solution (PVA235, manufactured by Kuraray Co., Ltd., weight average degree of polymerization: 3,500, saponification degree: 88 percent by mole, solid content: 8 percent by mass) 112.50 parts
- Surfactant (Surfynol 465, manufactured by Nissin Chemical Industry CO., Ltd.) 0.70 parts Zirconyl acetate (Zircosol ZA-30, manufactured by Daiichi Kigenso Kagaku Kogyo Co., Ltd., solid content: 30 percent by mass) 0.67 parts Orthoboric acid aqueous solution (solid content: 5 percent by mass) 23.00 parts (Composition of Lower-Layer Coating Liquid B1)

Alumina-hydrate dispersion liquid 435.00 parts

Poly(vinyl alcohol) aqueous solution (PVA235, manufactured by Kuraray Co., Ltd., weight average degree of polymerization: 3,500, saponification degree: 88 percent by mole, solid content: 8 percent by mass) 112.50 parts Zirconyl acetate (Zircosol ZA-30, manufactured by Daiichi Kigenso Kagaku Kogyo Co., Ltd., solid content: 30 percent by mass) 1.67 parts Orthoboric acid aqueous solution (solid content: 5 percent by mass) 40.00 parts (Formation of Ink Receiving Layer)

The above two types of coating liquids were applied on the surface side of the support substrate by a multilayer slide hopper type coating apparatus to form the total two layers, that is, one upper layer and one lower layer, so that the solid content coating amount of the lower-layer ink receiving layer was 25 g/m$^2$ and that of the upper-layer ink receiving layer was 10 g/m$^2$. Next, the coating liquids thus applied were dried at 60° C., and as a result, a recording medium 1 having the ink receiving layer was obtained.

[Formation of Recording Medium 2]

In the formation of the ink receiving layer of the recording medium 1, a recording medium 2 was obtained in a manner similar to that of the recording medium 1 except that the solid content coating amount of the lower-layer ink receiving layer and that of the upper-layer ink receiving layer were changed to 32 g/m$^2$ and 3 g/m$^2$, respectively.

[Formation of Recording Medium 3]

In the formation of the ink receiving layer of the recording medium 1, a recording medium 3 was obtained in a manner similar to that of the recording medium 1 except that the solid content coating amount of the lower-layer ink receiving layer and that of the upper-layer ink receiving layer were changed to 15 g/m$^2$ and 20 g/m$^2$, respectively.

[Formation of Recording Medium 4]

In the formation of the ink receiving layer of the recording medium 1, a recording medium 4 was obtained in a manner similar to that of the recording medium 1 except that the solid content coating amount of the lower-layer ink receiving layer was changed to 15 g/m$^2$.

[Formation of Recording Medium 5]

In the formation of the ink receiving layer of the recording medium 1, a recording medium 5 was obtained in a manner similar to that of the recording medium 1 except that the solid content coating amount of the lower-layer ink receiving layer was changed to 40 g/m$^2$.

[Formation of Recording Medium 6]

A recording medium 6 was obtained in a manner similar to that of the recording medium 1 except that in the composition of the upper-layer coating liquid A1 of the recording medium 1, the addition amount of zirconyl acetate was changed to 0.17 parts.

[Formation of Recording Medium 7]

A recording medium 7 was obtained in a manner similar to that of the recording medium 1 except that in the composition of the upper-layer coating liquid A1 of the recording medium 1, the addition amount of zirconyl acetate was changed to 2.67 parts.

[Formation of Recording Medium 8]

A recording medium 8 was obtained in a manner similar to that of the recording medium 1 except that in the composition of the lower-layer coating liquid B1 of the recording medium 1, the addition amount of zirconyl acetate was changed to 1.00 part.

[Formation of Recording Medium 9]

A recording medium 9 was obtained in a manner similar to that of the recording medium 1 except that in the composition of the lower-layer coating liquid B1 of the recording medium 1, the addition amount of zirconyl acetate was changed to 6.00 parts.

[Formation of Recording Medium 10]

A recording medium 10 was obtained in a manner similar to that of the recording medium 1 except that in the composition of the upper-layer coating liquid A1 of the recording medium 1, the addition amount of the orthoboric acid aqueous solution was changed to 6.00 parts.

[Formation of Recording Medium 11]

A recording medium 11 was obtained in a manner similar to that of the recording medium 1 except that in the composition of the upper-layer coating liquid A1 of the recording medium 1, the addition amount of the orthoboric acid aqueous solution was changed to 40.00 parts.

[Formation of Recording Medium 12]

A recording medium 12 was obtained in a manner similar to that of the recording medium 1 except that in the composition of the lower-layer coating liquid B1 of the recording medium 1, the addition amount of the orthoboric acid aqueous solution was changed to 20.00 parts.

[Formation of Recording Medium 13]

A recording medium 13 was obtained in a manner similar to that of the recording medium 1 except that in the composition of the lower-layer coating liquid B1 of the recording medium 1, the addition amount of the orthoboric acid aqueous solution was changed to 50.00 parts.

[Formation of Recording Medium 14]

A recording medium 14 was obtained in a manner similar to that of the recording medium 1 except that in the composition of the upper-layer coating liquid A1 of the recording medium 1, the addition amount of zirconyl acetate and that of the orthoboric acid aqueous solution were changed to 2.67 parts and 30.00 parts, respectively.

[Formation of Recording Medium 15]

A recording medium 15 was obtained in a manner similar to that of the recording medium 1 except that in the composition of the upper-layer coating liquid A1 of the recording medium 1, the addition amount of zirconyl acetate and that of the orthoboric acid aqueous solution were changed to 0.17 parts and 6.00 parts, respectively.

[Formation of Recording Medium 16]

A recording medium 16 was obtained in a manner similar to that of the recording medium 1 except that in the composition of the lower-layer coating liquid B1 of the recording medium 1, the addition amount of zirconyl acetate and that of the orthoboric acid aqueous solution were changed to 6.00 parts and 50.00 parts, respectively.

[Formation of Recording Medium 17]

A recording medium 17 was obtained in a manner similar to that of the recording medium 1 except that in the composition of the lower-layer coating liquid B1 of the recording medium 1, the addition amount of zirconyl acetate and that of the orthoboric acid aqueous solution were changed to 1.33 parts and 20.00 parts, respectively.

[Formation of Recording Medium 18]

A recording medium 18 was obtained in a manner similar to that of the recording medium 1 except that in the composition of the upper-layer coating liquid A1 of the recording medium 1, the addition amount of the poly(vinyl alcohol) aqueous solution was changed to 62.50 parts.

[Formation of Recording Medium 19]

A recording medium 19 was obtained in a manner similar to that of the recording medium 1 except that in the composition of the upper-layer coating liquid A1 of the recording medium 1, the addition amount of the poly(vinyl alcohol) aqueous solution was changed to 162.50 parts.

[Formation of Recording Medium 20]

A recording medium 20 was obtained in a manner similar to that of the recording medium 1 except that in the composition of the lower-layer coating liquid B1 of the recording medium 1, the addition amount of the poly(vinyl alcohol) aqueous solution was changed to 87.50 parts.

[Formation of Recording Medium 21]

A recording medium 21 was obtained in a manner similar to that of the recording medium 1 except that in the composition of the lower-layer coating liquid B1 of the recording medium 1, the addition amount of the poly(vinyl alcohol) aqueous solution was changed to 187.50 parts.

[Formation of Recording Medium 22]

A recording medium 22 was obtained in a manner similar to that of the recording medium 1 except that in the composition of the upper-layer coating liquid A1 of the recording medium 1, the addition amount of zirconyl acetate was changed to 3.33 parts.

[Formation of Recording Medium 23]

A recording medium 23 was obtained in a manner similar to that of the recording medium 1 except in the composition of the upper-layer coating liquid A1 of the recording medium 1, that the addition amount of the orthoboric acid aqueous solution was changed to 40.00 parts.

[Formation of Recording Medium 24]

A recording medium 24 was obtained in a manner similar to that of the recording medium 1 except that in the compositions of the upper-layer coating liquid A1 and the lower-layer coating liquid B1 of the recording medium 1, zirconyl acetate was changed to zirconium oxychloride (manufactured by Daiichi Kigenso Kagaku Kogyo Co., Ltd., solid content: 33 percent by mass).

[Formation of Recording Medium 25]

A recording medium 25 was obtained in a manner similar to that of the recording medium 1 except that in the compositions of the upper-layer coating liquid A1 and the lower-layer coating liquid B1 of the recording medium 1, zirconyl acetate was changed to zirconyl nitrate oxychloride (Zircosol ZN, manufactured by Daiichi Kigenso Kagaku Kogyo Co., Ltd., solid content: 25 percent by mass).

[Formation of Recording Medium 26]

In the compositions of the upper-layer coating liquid A1 and the lower-layer coating liquid B1 of the recording medium 1, the poly(vinyl alcohol) aqueous solution was changed to a different poly(vinyl alcohol) aqueous solution (JM26, manufactured by JAPAN VAM & POVAL CO., LTD., weight average degree of polymerization: 2,600, saponification degree: 97 percent by mole, solid content: 8 percent by mass). A recording medium 26 was obtained in a manner similar to that of the recording medium 1 except that described above.

[Formation of Recording Medium 27]

In the compositions of the upper-layer coating liquid A1 and the lower-layer coating liquid B1 of the recording medium 1, the poly(vinyl alcohol) aqueous solution was changed to a different poly(vinyl alcohol) aqueous solution (PVA420, manufactured by Kuraray Co., Ltd., weight average degree of polymerization: 2,000, saponification degree: 80 percent by mole, solid content: 8 percent by mass). A recording medium 27 was obtained in a manner similar to that of the recording medium 1 except that described above.

[Formation of Recording Medium 28]

A recording medium 28 was obtained in a manner similar to that of the recording medium 1 except the composition of the lower-layer coating liquid B1 of the recording medium 1 was changed to the following composition B2.

(Composition of Lower-Layer Coating Liquid B2)

- Alumina-hydrate dispersion liquid 435.00 parts
- Poly(vinyl alcohol) aqueous solution (PVA235, manufactured by Kuraray Co., Ltd., weight average degree of polymerization: 3,500, saponification degree: 88 percent by mole, solid content: 8 percent by mass) 112.50 parts
- Diallyamine hydrochloride-sulfur dioxide copolymer resin (PAS-92, manufactured by Nitto Boseki Co., Ltd., solid content: 20 percent by mass) 2.50 parts
- Zirconyl acetate (Zircosol ZA-30, manufactured by Daiichi Kigenso Kagaku Kogyo Co., Ltd., solid content: 30 percent by mass) 1.67 parts
- Orthoboric acid aqueous solution (solid content: 5 percent by mass) 40.00 parts

[Formation of Recording Medium 29]

A recording medium 29 was obtained in a manner similar to that of the recording medium 1 except that the composition of the upper-layer coating liquid A1 of the recording medium 1 was changed to the following composition A2.

(Composition of Upper-Layer Coating Liquid A2)

- Alumina-hydrate dispersion liquid 348.00 parts
- Alumina dispersion liquid 87.00 parts
- Poly(vinyl alcohol) aqueous solution (PVA235, manufactured by Kuraray Co., Ltd., weight average degree of polymerization: 3,500, saponification degree: 88 percent by mole, solid content: 8 percent by mass) 112.50 parts
- Surfactant (Surfynol 465, manufactured by Nissin Chemical Industry CO., Ltd.) 0.70 parts
- Zirconyl acetate (Zircosol ZA-30, manufactured by Daiichi Kigenso Kagaku Kogyo Co., Ltd., solid content: 30 percent by mass) 0.67 parts
- Orthoboric acid aqueous solution (solid content: 5 percent by mass) 23.00 parts

[Formation of Recording Medium 30]

A recording medium 30 was obtained in a manner similar to that of the recording medium 1 except that the composition of the upper-layer coating liquid A1 of the recording medium 1 was changed to the following composition A3.

(Composition of Upper-Layer Coating Liquid A3)

- Alumina-hydrate dispersion liquid 435.00 parts
- Cationic polyurethane emulsion 15.00 parts
- Poly(vinyl alcohol) aqueous solution (PVA235, manufactured by Kuraray Co., Ltd., weight average degree of polymerization: 3,500, saponification degree: 88 percent by mole, solid content: 8 percent by mass) 112.50 parts Surfactant (Surfynol 465, manufactured by Nissin Chemical Industry CO., Ltd.) 0.70 parts Zirconyl acetate (Zircosol ZA-30, manufactured by Daiichi Kigenso Kagaku Kogyo Co., Ltd., solid content: 30 percent by mass) 0.67 parts Orthoboric acid aqueous solution (solid content: 5 percent by mass) 23.00 parts

[Formation of Recording Medium 31]

A recording medium 31 was obtained in a manner similar to that of the recording medium 1 except that in the composition of the upper-layer coating liquid A1 of the recording medium 1, the addition amount of zirconyl acetate was changed to 4.33 parts.

[Formation of Recording Medium 32]

A recording medium 32 was obtained in a manner similar to that of the recording medium 1 except that in the composition of the lower-layer coating liquid B1 of the recording medium 1, the addition amount of zirconyl acetate was changed to 7.33 parts.

[Formation of Recording Medium 33]

A recording medium 33 was obtained in a manner similar to that of the recording medium 1 except that in the compositions of the upper-layer coating liquid A1 and the lower-layer coating liquid B1 of the recording medium 1, zirconyl acetate was not added.

[Formation of Recording Medium 34]

A recording medium 34 was obtained in a manner similar to that of the recording medium 1 except that in the composition of the upper-layer coating liquid A1 of the recording medium 1, zirconyl acetate was not added.

[Formation of Recording Medium 35]

A recording medium 35 was obtained in a manner similar to that of the recording medium 1 except that in the composition of the lower-layer coating liquid B1 of the recording medium 1, zirconyl acetate was not added.

[Formation of Recording Medium 36]

A recording medium 36 was obtained in a manner similar to that of the recording medium 1 except that in the compositions of the upper-layer coating liquid A1 and the lower-layer coating liquid B1 of the recording medium 1, the orthoboric acid aqueous solution was not added.

[Formation of Recording Medium 37]

A recording medium 37 was obtained in a manner similar to that of the recording medium 1 except that in the composition of the upper-layer coating liquid A1 of the recording medium 1, the orthoboric acid aqueous solution was not added.

[Formation of Recording Medium 38]

A recording medium 38 was obtained in a manner similar to that of the recording medium 1 except that in the composition of the lower-layer coating liquid B1 of the recording medium 1, the orthoboric acid aqueous solution was not added.

[Formation of Recording Medium 39]

A recording medium 39 was obtained in a manner similar to that of the recording medium 1 except that in the composition of the upper-layer coating liquid A1 of the recording medium 1, the addition amount of zirconyl acetate and that of the orthoboric acid aqueous solution were changed to 0.50 parts and 2.00 parts, respectively.

[Formation of Recording Medium 40]

A recording medium 40 was obtained in a manner similar to that of the recording medium 1 except that in the composition of the lower-layer coating liquid B1 of the recording medium 1, the addition amount of zirconyl acetate and that of the orthoboric acid aqueous solution were changed to 0.20 parts and 1.15 parts, respectively.

[Formation of Recording Medium 41]

A recording medium 41 was obtained in a manner similar to that of the recording medium 1 except that in the composition of the upper-layer coating liquid A1 of the recording medium 1, the addition amount of zirconyl acetate and that of the orthoboric acid aqueous solution were changed to 0.80 parts and 2.00 parts, respectively.

[Formation of Recording Medium 42]

A recording medium 42 was obtained in a manner similar to that of the recording medium 1 except that in the composition of the lower-layer coating liquid B1 of the recording medium 1, the addition amount of zirconyl acetate and that of the orthoboric acid aqueous solution were changed to 0.20 parts and 1.00 part, respectively.

[Formation of Recording Medium 43]

In the composition of the upper-layer coating liquid A1 of the recording medium 1, zirconyl acetate was not added, and the addition amount of the orthoboric acid aqueous solution was changed to 1.35 parts. In addition, in the composition of the lower-layer coating liquid B1 of the recording medium 1, zirconyl acetate was not added, and the addition amount of the orthoboric acid aqueous solution was changed to 2.50 parts. A recording medium 43 was obtained in a manner similar to that of the recording medium 1 except that described above.

[Formation of Recording Medium 44]

A recording medium 44 was obtained in a manner similar to that of the recording medium 1 except that in the composition of the upper-layer coating liquid A1 of the recording medium 1 was changed to the following composition A4.

(Composition of Upper-Layer Coating Liquid A4)

Vapor phase method-silica dispersion liquid 500.00 parts

Cationic polyurethane emulsion 15.00 parts

Poly(vinyl alcohol) solution (PVA235, manufactured by Kuraray Co., Ltd., weight average degree of polymerization: 3,500, saponification degree: 88 percent by mole, solid content: 8 percent by mass) 250.00 parts Surfactant (Surfynol 465, manufactured by Nissin Chemical Industry CO., Ltd.) 0.70 parts Zirconyl acetate (Zircosol ZA-30, manufactured by Daiichi Kigenso Kagaku Kogyo Co., Ltd., solid content: 30 percent by mass) 3.33 parts Orthoboric acid aqueous solution (solid content: 5 percent by mass) 60.00 parts

[Formation of Recording Medium 45]

A recording medium 45 was obtained in a manner similar to that of the recording medium 1 except the composition of the lower-layer coating liquid B1 of the recording medium 1 was changed to the following component B3.

(Composition of Lower-Layer Coating Liquid B3)

Vapor phase method-silica dispersion liquid 500.00 parts

Poly(vinyl alcohol) aqueous solution (PVA235, manufactured by Kuraray Co., Ltd., weight average degree of polymerization: 3,500, saponification degree: 88 percent by mole, solid content: 8 percent by mass) 250.00 parts Zirconyl acetate (Zircosol ZA-30, manufactured by Daiichi Kigenso Kagaku Kogyo Co., Ltd., solid content: 30 percent by mass) 6.67 parts Orthoboric acid aqueous solution (solid content: 5 percent by mass) 80.00 parts

[Formation of Recording Medium 46]

A recording medium 46 was obtained in a manner similar to that of the recording medium 1 except that the composition of the upper-layer coating liquid A1 of the recording medium 1 was changed to the above composition A4, and that the composition of the lower-layer coating liquid B1 of the recording medium 1 was changed to the above composition B3.

[Evaluation Methods]

<Crack Resistance>

The surface of the ink receiving layer of each of the above recording media was observed, and the crack resistance thereof was evaluated based on the following criteria.

Rank 5: No cracks were observed by using a microscope.

Rank 4: Although no cracks were observed with the naked eye, minute cracks were partially observed by using a microscope.

Rank 3: Although no cracks were observed with the naked eye, many minute cracks were observed by using a microscope.

Rank 2: Cracks were partially observed with the naked eye.

Rank 1: Many cracks were observed with the naked eye.

<Bronzing Resistance>

After the above recording media were each held for 6 hours in a high humidity environment at a temperature of 30° C. and a relative humidity of 80%, a solid image of cyan was formed on each recording medium in the same environment as described above using an ink jet printer MP980 (trade name, manufactured by CANON KABUSHIKI KAISHA). Subsequently, the generation of bronzing was evaluated by a visual inspection based on the following criteria.

Rank 5: No generation of bronzing was observed.

Rank 4: Redness was slightly observed in reflected light.

Rank 3: Redness was observed to a certain extent in reflected light.

Rank 2: Bronzing having metallic gloss was observed.

Rank 1: Gloss was lost by bronzing.

<Color Development Property>

An image having a duty of 100% was recorded on each of the above recording media by a black (Bk) ink using iP4600 (trade name, manufactured by CANON KABUSHIKI KAISHA). After the recording was performed, the optical density was measured using an optical reflection density meter (530 spectrum densitometer, manufactured by X-Rite Inc.), and the rank was determined based on the following criteria.

Rank 5: 2.20 or more

Rank 4: From 2.10 to less than 2.20

Rank 3: From 2.00 to less than 2.10

Rank 2: From 1.90 to less than 2.00

Rank 1: Less than 1.90

<Ink Absorbency>

The ink absorbency of each of the above recording media was evaluated. Printing was performed using an apparatus which modified a printing processing method of iP4600 (trade name, manufactured by CANON KABUSHIKI KAISHA). A printing pattern used solid green color having 64 gradations (64 gradations in increments of a duty of 6.25%, a duty from 0% to 400%). In particular, 64 types of one inch-square solid images having a duty in a range of 0% to 400% in increments of a duty of 6.25% were formed. Each solid image was formed by bidirectional printing in which printing was completed when a carriage was reciprocated twice at a rate of 25 inches per second. Incidentally, the duty of 400% indicates that 44 ng of ink is supplied per 1/600 square inch using an ink jet head having a resolution of 600 dpi. Since the ink absorbency had an approximate correlation with beading, the ink absorbency of the recording medium was evaluated by evaluating the beading. The beading indicates a phenomenon in which before an ink droplet supplied to the surface is absorbed in an ink receiving layer, this ink droplet comes into contact with an adjacent ink droplet to form an image having color irregularity. Evaluation was performed by a visual inspection, and the rank was determined based on the following evaluation criteria.

Rank 4: No beading was observed even at a duty of 300%.

Rank 3: Although beading was slightly observed at a duty in a range of 250% to 300%, no beading was observed at a duty of less than 250%.

Rank 2: Although beading was slightly observed at a duty in a range of 200% to 250%, no beading was observed at a duty of less than 200%.

Rank 1: Beading was observed even at a duty of less than 200%.

<Roller-Mark Resistance>

After the above recording media were each held for 6 hours in a high humidity environment at a temperature of 30° C. and a relative humidity of 80%, a solid image of black was printed on each recording medium in the same environment as described above by a platinum mode (default setting) of an ink-jet printer PIXUS MP990 (trade name, manufactured by CANON KABUSHIKI KAISHA). Scratches on the surface of a printed image at a conveying roller passing portion were evaluated by a visual inspection based on the following criteria.

Rank 5: No roller mark was observed.

Rank 4: One slight roller mark was observed.

Rank 3: A plurality of slight roller marks was observed.

Rank 2: Besides slight roller marks, one clear roller mark was also observed.

Rank 1: A plurality of clear roller marks was observed.

<Bending Crack Resistance>

After humidity conditioning of the above recording media was performed at a temperature of 15° C. and a relative humidity of 10%, the recording media were wound around cylinders having diameters of 6, 12, 16, and 20 mm to determine the diameter of the cylinder at which a crack was generated in the ink receiving layer, and the evaluation was performed by a visual inspection based on the following criteria.

Rank 5: No bending cracks were generated by all the cylinders.

Rank 4: A bending crack was generated only when a cylinder having a diameter of 6 mm was used.

Rank 3: Bending cracks were generated only when cylinders having diameters of 6 and 12 mm were used.

Rank 2: Bending cracks were generated only when cylinders having diameters of 6, 12, and 16 mm were used.

Rank 1: Bending cracks were generated when all the cylinders having diameters of 6, 12, 16, and 20 mm were used.

The layer structures and the evaluation results of the ink jet recording media described above are shown in Tables 1 and 2.

TABLE 1

| | | UPPER LAYER ADDITION AMOUNT (%) OF CROSS LINKING AGENT TO TOTAL AMOUNT OF ALUMINA AND ALUMINA HYDRATE | | | LOWER LAYER ADDITION AMOUNT (%) OF CROSS LINKING AGENT TO TOTAL AMOUNT OF ALUMINA AND ALUMINA HYDRATE | | | EVALUATION | | | | | |
|---|---|---|---|---|---|---|---|---|---|---|---|---|---|
| | | BORIC ACID AND BORATE (a) | WATER-SOLUBLE Zr SALT (b) | TOTAL (a + b) | BORIC ACID AND BORATE (a) | WATER-SOLUBLE Zr SALT (b) | TOTAL (a + b) | CRACK RESISTANCE | BRONZING RESISTANCE | COLOR DEVELOPMENT | INK ABSORBENCY | ROLLER-MARK RESISTANCE | BENDING CRACK RESISTANCE |
| EXAMPLE 1 | RECORDING MEDIUM 1 | 1.15 | 0.20 | 1.35 | 2.00 | 0.50 | 2.50 | 5 | 5 | 5 | 5 | 5 | 5 |
| EXAMPLE 2 | RECORDING MEDIUM 2 | 1.15 | 0.20 | 1.35 | 2.00 | 0.50 | 2.50 | 5 | 4 | 4 | 5 | 5 | 3 |
| EXAMPLE 3 | RECORDING MEDIUM 3 | 1.15 | 0.20 | 1.35 | 2.00 | 0.50 | 2.50 | 5 | 5 | 5 | 5 | 3 | 5 |
| EXAMPLE 4 | RECORDING MEDIUM 4 | 1.15 | 0.20 | 1.35 | 2.00 | 0.50 | 2.50 | 5 | 3 | 3 | 3 | 5 | 5 |
| EXAMPLE 5 | RECORDING MEDIUM 5 | 1.15 | 0.20 | 1.35 | 2.00 | 0.50 | 2.50 | 3 | 5 | 5 | 5 | 3 | 3 |
| EXAMPLE 6 | RECORDING MEDIUM 6 | 1.15 | 0.05 | 1.20 | 2.00 | 0.50 | 2.50 | 5 | 5 | 5 | 5 | 3 | 5 |
| EXAMPLE 7 | RECORDING MEDIUM 7 | 1.15 | 0.80 | 1.95 | 2.00 | 0.50 | 2.50 | 4 | 3 | 3 | 4 | 5 | 3 |
| EXAMPLE 8 | RECORDING MEDIUM 8 | 1.15 | 0.20 | 1.35 | 2.00 | 0.30 | 2.30 | 5 | 5 | 5 | 5 | 3 | 5 |
| EXAMPLE 9 | RECORDING MEDIUM 9 | 1.15 | 0.20 | 1.35 | 2.00 | 1.80 | 3.80 | 3 | 4 | 4 | 5 | 5 | 3 |
| EXAMPLE 10 | RECORDING MEDIUM 10 | 0.30 | 0.20 | 0.50 | 2.00 | 0.50 | 2.50 | 4 | 5 | 4 | 3 | 3 | 5 |
| EXAMPLE 11 | RECORDING MEDIUM 11 | 2.00 | 0.20 | 2.20 | 2.00 | 0.50 | 2.50 | 5 | 4 | 4 | 5 | 5 | 3 |
| EXAMPLE 12 | RECORDING MEDIUM 12 | 1.15 | 0.20 | 1.35 | 1.00 | 0.50 | 1.50 | 4 | 5 | 5 | 4 | 3 | 5 |
| EXAMPLE 13 | RECORDING MEDIUM 13 | 1.15 | 0.20 | 1.35 | 2.50 | 0.50 | 3.00 | 5 | 5 | 5 | 5 | 5 | 3 |
| EXAMPLE 14 | RECORDING MEDIUM 14 | 1.50 | 0.80 | 2.30 | 2.00 | 0.50 | 2.50 | 5 | 3 | 3 | 5 | 5 | 3 |
| EXAMPLE 15 | RECORDING MEDIUM 15 | 0.30 | 0.05 | 0.35 | 2.00 | 0.50 | 2.50 | 5 | 5 | 5 | 4 | 3 | 5 |

TABLE 1-continued

| | | UPPER LAYER ADDITION AMOUNT (%) OF CROSS LINKING AGENT TO TOTAL AMOUNT OF ALUMINA AND ALUMINA HYDRATE | | | LOWER LAYER ADDITION AMOUNT (%) OF CROSS LINKING AGENT TO TOTAL AMOUNT OF ALUMINA AND ALUMINA HYDRATE | | | EVALUATION | | | | | |
|---|---|---|---|---|---|---|---|---|---|---|---|---|---|
| | | BORIC ACID AND BORATE (a) | WATER-SOLUBLE Zr SALT (b) | TOTAL (a + b) | BORIC ACID AND BORATE (a) | WATER-SOLUBLE Zr SALT (b) | TOTAL (a + b) | CRACK RESISTANCE | BRONZING RESISTANCE | COLOR DEVELOPMENT | INK ABSORBENCY | ROLLER-MARK RESISTANCE | BENDING CRACK RESISTANCE |
| EXAMPLE 16 | RECORDING MEDIUM 16 | 1.15 | 0.20 | 1.35 | 2.50 | 1.80 | 4.30 | 3 | 3 | 3 | 5 | 5 | 3 |
| EXAMPLE 17 | RECORDING MEDIUM 17 | 1.15 | 0.20 | 1.35 | 1.00 | 0.40 | 1.40 | 5 | 5 | 5 | 4 | 3 | 5 |
| EXAMPLE 18 | RECORDING MEDIUM 18 | 1.15 | 0.20 | 1.35 | 2.00 | 0.50 | 2.50 | 3 | 5 | 5 | 5 | 3 | 4 |
| EXAMPLE 19 | RECORDING MEDIUM 19 | 1.15 | 0.20 | 1.35 | 2.00 | 0.50 | 2.50 | 5 | 3 | 4 | 3 | 5 | 5 |
| EXAMPLE 20 | RECORDING MEDIUM 20 | 1.15 | 0.20 | 1.35 | 2.00 | 0.50 | 2.50 | 4 | 5 | 5 | 5 | 3 | 3 |
| EXAMPLE 21 | RECORDING MEDIUM 21 | 1.15 | 0.20 | 1.35 | 2.00 | 0.50 | 2.50 | 5 | 4 | 4 | 4 | 5 | 5 |
| EXAMPLE 22 | RECORDING MEDIUM 22 | 1.15 | 1.00 | 2.15 | 2.00 | 0.50 | 2.50 | 4 | 4 | 3 | 3 | 5 | 5 |

TABLE 2

| | | UPPER LAYER ADDITION AMOUNT (%) OF CROSS LINKING AGENT TO TOTAL AMOUNT OF ALUMINA AND ALUMINA HYDRATE | | | LOWER LAYER ADDITION AMOUNT (%) OF CROSS LINKING AGENT TO TOTAL AMOUNT OF ALUMINA AND ALUMINA HYDRATE | | | EVALUATION | | | | | |
|---|---|---|---|---|---|---|---|---|---|---|---|---|---|
| | | BORIC ACID AND BORATE (a) | WATER-SOLUBLE Zr SALT (b) | TOTAL (a + b) | BORIC ACID AND BORATE (a) | WATER-SOLUBLE Zr SALT (b) | TOTAL (a + b) | CRACK RESISTANCE | BRONZING RESISTANCE | COLOR DEVELOPMENT | INK ABSORBENCY | ROLLER-MARK RESISTANCE | BENDING CRACK RESISTANCE |
| EXAMPLE 23 | RECORDING MEDIUM 23 | 2.00 | 0.20 | 2.20 | 2.00 | 0.50 | 2.50 | 5 | 5 | 4 | 5 | 5 | 3 |
| EXAMPLE 24 | RECORDING MEDIUM 24 | 1.15 | 0.20 | 1.35 | 2.00 | 0.50 | 2.50 | 5 | 4 | 5 | 4 | 5 | 5 |
| EXAMPLE 25 | RECORDING MEDIUM 25 | 1.15 | 0.20 | 1.35 | 2.00 | 0.50 | 2.50 | 5 | 3 | 4 | 4 | 5 | 4 |
| EXAMPLE 26 | RECORDING MEDIUM 26 | 1.15 | 0.20 | 1.35 | 2.00 | 0.50 | 2.50 | 5 | 5 | 3 | 5 | 5 | 5 |
| EXAMPLE 26 | RECORDING MEDIUM 26 | 1.15 | 0.20 | 1.35 | 2.00 | 0.50 | 2.50 | 5 | 5 | 4 | 5 | 5 | 5 |
| EXAMPLE 27 | RECORDING MEDIUM 27 | 1.15 | 0.20 | 1.35 | 2.00 | 0.50 | 2.50 | 5 | 5 | 3 | 5 | 5 | 4 |
| EXAMPLE 28 | RECORDING MEDIUM 28 | 1.15 | 0.20 | 1.35 | 2.00 | 0.50 | 2.50 | 5 | 5 | 5 | 5 | 5 | 5 |
| EXAMPLE 29 | RECORDING MEDIUM 29 | 1.15 | 0.20 | 1.35 | 2.00 | 0.50 | 2.50 | 5 | 5 | 5 | 4 | 5 | 5 |
| EXAMPLE 30 | RECORDING MEDIUM 30 | 1.15 | 0.20 | 1.35 | 2.00 | 0.50 | 2.50 | 5 | 3 | 5 | 3 | 5 | 5 |
| EXAMPLE 31 | RECORDING MEDIUM 31 | 1.15 | 1.30 | 2.45 | 2.00 | 0.50 | 2.50 | 3 | 3 | 4 | 3 | 5 | 3 |
| EXAMPLE 32 | RECORDING MEDIUM 32 | 1.15 | 0.20 | 1.35 | 2.00 | 2.20 | 4.20 | 3 | 4 | 4 | 4 | 5 | 3 |
| COMPARATIVE EXAMPLE 1 | RECORDING MEDIUM 33 | 1.15 | 0.00 | 1.15 | 2.00 | 0.00 | 2.00 | 5 | 5 | 5 | 3 | 1 | 5 |
| COMPARATIVE EXAMPLE 2 | RECORDING MEDIUM 34 | 1.15 | 0.00 | 1.15 | 2.00 | 0.50 | 2.50 | 5 | 5 | 5 | 3 | 2 | 5 |
| COMPARATIVE EXAMPLE 3 | RECORDING MEDIUM 35 | 1.15 | 0.20 | 1.35 | 2.00 | 0.00 | 2.00 | 5 | 5 | 5 | 3 | 2 | 5 |
| COMPARATIVE EXAMPLE 4 | RECORDING MEDIUM 36 | 0.00 | 0.20 | 0.20 | 0.00 | 0.50 | 0.50 | 1 | NOT EVALUABLE | NOT EVALUABLE | NOT EVALUABLE | NOT EVALUABLE | NOT EVALUABLE |
| COMPARATIVE EXAMPLE 5 | RECORDING MEDIUM 37 | 0.00 | 0.20 | 0.20 | 2.00 | 0.50 | 2.50 | 2 | 1 | 2 | 1 | 1 | 5 |
| COMPARATIVE EXAMPLE 6 | RECORDING MEDIUM 38 | 1.15 | 0.20 | 1.35 | 0.00 | 0.50 | 0.50 | 2 | 4 | 4 | 3 | 1 | 5 |
| COMPARATIVE EXAMPLE 7 | RECORDING MEDIUM 39 | 2.00 | 0.50 | 2.50 | 2.00 | 0.50 | 2.50 | 5 | 2 | 4 | 4 | 5 | 1 |

TABLE 2-continued

| | | UPPER LAYER ADDITION AMOUNT (%) OF CROSS LINKING AGENT TO TOTAL AMOUNT OF ALUMINA AND ALUMINA HYDRATE | | | LOWER LAYER ADDITION AMOUNT (%) OF CROSS LINKING AGENT TO TOTAL AMOUNT OF ALUMINA AND ALUMINA HYDRATE | | | EVALUATION | | | | | |
|---|---|---|---|---|---|---|---|---|---|---|---|---|---|
| | | BORIC ACID AND BORATE (a) | WATER-SOLUBLE Zr SALT (b) | TOTAL (a + b) | BORIC ACID AND BORATE (a) | WATER-SOLUBLE Zr SALT (b) | TOTAL (a + b) | CRACK RESISTANCE | BRONZING RESISTANCE | COLOR DEVELOPMENT | INK ABSORBENCY | ROLLER-MARK RESISTANCE | BENDING CRACK RESISTANCE |
| COMPARATIVE EXAMPLE 8 | RECORDING MEDIUM 40 | 1.15 | 0.20 | 1.35 | 1.15 | 0.20 | 1.35 | 3 | 3 | 3 | 3 | 1 | 5 |
| COMPARATIVE EXAMPLE 9 | RECORDING MEDIUM 41 | 2.00 | 0.80 | 2.80 | 2.00 | 0.50 | 2.50 | 5 | 2 | 3 | 5 | 5 | 1 |
| COMPARATIVE EXAMPLE 10 | RECORDING MEDIUM 42 | 1.15 | 0.20 | 1.35 | 1.00 | 0.20 | 1.20 | 4 | 5 | 5 | 4 | 1 | 5 |
| COMPARATIVE EXAMPLE 11 | RECORDING MEDIUM 43 | 1.35 | 0.00 | 1.35 | 2.50 | 0.00 | 2.50 | 5 | 5 | 5 | 5 | 2 | 3 |
| COMPARATIVE EXAMPLE 12 | RECORDING MEDIUM 44 | 3.00 | 1.00 | 4.00 | 2.00 | 0.50 | 2.50 | 2 | 2 | 2 | 3 | 5 | 3 |
| COMPARATIVE EXAMPLE 13 | RECORDING MEDIUM 45 | 1.15 | 0.20 | 1.35 | 4.00 | 2.00 | 6.00 | 2 | 4 | 4 | 4 | 5 | 2 |
| COMPARATIVE EXAMPLE 14 | RECORDING MEDIUM 46 | 3.00 | 1.00 | 4.00 | 4.00 | 2.00 | 6.00 | 1 | 2 | 2 | 2 | 5 | 1 |

As shown in Tables 1 and 2, the recording media 1 to 32 had comprehensively good properties in terms of the crack resistance, the bronzing resistance, the image density, the ink absorbency, the roller-mark resistance, and the bending crack resistance. On the other hand, the recording media 33 to 46 are inferior in at least one of the properties described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-097076 filed Apr. 20, 2010, which is hereby incorporated by reference herein in its entirety.

What is claimed is:

1. An ink jet recording medium comprising:

a support substrate; and at least two ink receiving layers provided on the support substrate, wherein among the at least two ink receiving layers, two ink receiving layers each contain at least one selected from alumina and an alumina hydrate, a poly(vinyl alcohol), at least one selected from boric acid and a borate, and a water-soluble zirconium compound, and the total content of boric acid, a borate, and a water-soluble zirconium salt of one of the two ink receiving layers located close to the support substrate to the total content of alumina and an alumina hydrate thereof is higher than the total content of boric acid, a borate, and a water-soluble zirconium salt of the other one of the two ink receiving layers located apart from the support substrate to the total content of alumina and an alumina hydrate thereof.

2. The ink jet recording medium according to claim 1, wherein the water-soluble zirconium salt includes zirconyl acetate.

3. The ink jet recording medium according to claim 1, wherein the difference between the total content of boric acid, a borate, and a water-soluble zirconium salt of the ink receiving layer located close to the support substrate to the total content of alumina and an alumina hydrate thereof and the total content of boric acid, a borate, and a water-soluble zirconium salt of the ink receiving layer located apart from the support substrate to the total content of alumina and an alumina hydrate thereof is 0.2 to 3.0 percent by mass.

4. The ink jet recording medium according to claim 1, wherein the total amount of boric acid and a borate of the ink receiving layer located close to the support substrate to the total amount of alumina and an alumina hydrate thereof is 1.0 to 2.5 percent by mass, and the total amount of boric acid and a borate of the ink receiving layer located apart from the support substrate to the total amount of alumina and an alumina hydrate thereof is 0.3 to 2.0 percent by mass.

5. The ink jet recording medium according to claim 1, wherein the amount of a water-soluble zirconium compound of the ink receiving layer located close to the support substrate to the total amount of alumina and an alumina hydrate thereof is 0.3 to 2.20 percent by mass, and the amount of a water-soluble zirconium compound of the ink receiving layer located apart from the support substrate to the total amount of alumina and an alumina hydrate thereof is 0.05 to 1.00 percent by mass.

6. The ink jet recording medium according to claim 1, wherein the amount of a poly(vinyl alcohol) of the ink receiving layer located close to the support substrate to the total amount of alumina and an alumina hydrate thereof is 7.0 to 15.0 percent by mass, and the amount of a poly(vinyl alcohol) of the ink receiving layer located apart from the support substrate to the total amount of alumina and an alumina hydrate thereof is 5.0 to 13.0 percent by mass.

* * * * *